United States Patent [19]

Kondo et al.

[11] 4,389,477

[45] Jun. 21, 1983

[54] PHOTOCONDUCTIVE COMPOSITION SENSITIZED BY A THIOBARBITURIC ACID DERIVATIVE

[75] Inventors: Syunichi Kondo; Hirotsugu Nomaguchi; Hideo Sato, all of Asaka, Japan

[73] Assignee: Fuji Photo Film Co., Ltd., Kanagawa, Japan

[21] Appl. No.: 256,211

[22] Filed: Apr. 21, 1981

[30] Foreign Application Priority Data

Apr. 22, 1980 [JP] Japan ..... 55/53125

[51] Int. Cl.[3] ..... G03G 5/09

[52] U.S. Cl. ..... 430/81; 430/83; 430/900

[58] Field of Search ..... 430/81, 83, 900

[56] References Cited

U.S. PATENT DOCUMENTS 3,287,119 11/1966 Hoegl ..... 430/81 X

FOREIGN PATENT DOCUMENTS 2129087 12/1971 Fed. Rep. of Germany ..... 430/83

54-99440 6/1979 Japan ..... 430/83

*Primary Examiner*—Roland E. Martin, Jr.

*Attorney, Agent, or Firm*—Sughrue, Mion, Zinn, Macpeak and Seas

[57] ABSTRACT

A photoconductive composition comprising a photoconductive substance and a thiobarbituric acid derivative, and an electrophotographic light-sensitive medium comprising a support having a layer of the photoconductive composition thereon.

13 Claims, No Drawings

PHOTOCONDUCTIVE COMPOSITION SENSITIZED BY A THIOBARBITURIC ACID DERIVATIVE

FIELD OF THE INVENTION

This invention relates to a photoconductive composition and a high sensitivity electrophotographic light-sensitive medium prepared using the photoconductive composition.

BACKGROUND OF THE INVENTION

Utilization of organic light-semiconductors in electrophotography has heretofore been studied. From German Patent Publication No. 1,068,115 and U.S. Pat. No. 3,037,861, it is known that polyvinyl carbazole is photoconductive and can be used in electrophotographic processes. Furthermore, addition of a small amount of dye is disclosed as increasing the photosensitivity of polyvinyl carbazole.

German Patent Publication No. 1,572,347 and U.S. Pat. No. 3,484,237 disclose an electrophotographic recording medium bearing a photoconductive coating film prepared from a photoconductive composition comprising a polymer of a heterocyclic vinyl compound, e.g., polyvinyl carbazole, and 0.49 to 1.23 moles of 2,4,7-trinitro-9-fluorenone per mole of the repeating unit of the polymer.

The electrophotographic recording medium as disclosed in German Unexamined Patent Publication (OLS) No. 1,797,561 has an electrophotographic coating film prepared from a photoconductive composition containing equal parts by weight of 2,4,7-trinitro-9-fluorenone and polyvinyl carbazole.

R. M. Schefelt describes in *IBM Journal of Research and Development,* Vol. 15, No. 1, pages 75 to 89 (1971) that the above described recording media have excellent properties resulting from charge transfer complexes constituting their photoconductive coating films. Furthermore, the disclosure is that a number of substances which are described as sensitizers for polyvinyl carbazole have low mutual-solubility with polyvinyl carbonzole and when used in higher concentrations, these substances adversely influence the photosensitivity (ibid, p. 76) and that none of these substances are as useful as 2,4,7-trinitro-9-fluorenone (ibid, p. 77).

Trinitrofluorenone is a relatively expensive substance and has very high physiological activity.

SUMMARY OF THE INVENTION

An object of this invention is to provide compounds which, when used in combination with photoconductive substances, exhibit a photosensitivity equal to that of the conventional polyvinyl carbazole-trinitrofluorenone composition and which are available industrially and at low cost.

It has now been found that the object of this invention is attained by using thiobarbituric acid derivatives.

This invention, therefore, provides, in one embodiment, a photoconductive composition comprising a photoconductive substance and a thiobarbituric acid derivative represented by the Formula (I):

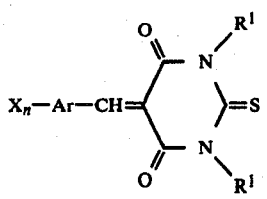

(I)

wherein $R^1$ is an alkyl group containing 1 to 12 carbon atoms, an alkoxyl group containing 1 to 5 carbon atoms or a phenyl group; X is a hydrogen atom, a halogen atom, a cyano group or a nitro group; Ar is a divalent, trivalent or tetravalent group derived from benzene, naphthalene, pyridine, furan or thiophene; and n is 1, 2 or 3 and, in a second embodiment, an electrophotographic light-sensitive medium comprising a support with an electrically conductive surface and a layer of the photoconductive composition described above on the support.

DETAILED DESCRIPTION OF THE INVENTION

The thiobarbituric acid derivatives which can be used in the photoconductive composition of this invention are represented by Formula (I):

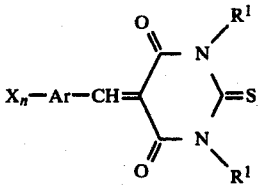

(I)

wherein $R^1$ is an alkyl group containing 1 to 12 carbon atoms, an alkoxyl group containing 1 to 5 carbon atoms or a phenyl group; X is a hydrogen atom, a halogen atom, a cyano group or a nitro group; Ar is a divalent, trivalent or tetravalent group derived from benzene, naphthalene, pyridine, furan or thiophene; and n is 1, 2 or 3.

The alkyl group, the alkoxyl group and the phenyl group may include a substituted alkyl group, a substituted alkoxyl group and a substituted phenyl group, respectively.

As examples of substituents for the substituted alkyl groups there are a halogen atom, such as a chlorine atom, bromine atom, etc., and a hydroxyl group, as those for the substituted alkoxyl group there is a halogen atom, such as a chlorine atom, bromine atom, etc., and as those for the substituted phenyl group there are a halogen atom, such as a chlorine atom, bromine atom etc., and an alkyl group containing 1 to 5 carbon atoms.

Representative examples of alkyl groups containing 1 to 12 carbon atoms include a methyl group, an ethyl group, a propyl group, a butyl group, a pentyl group, a hexyl group, an octyl group, a nonyl group, a decyl group, a dodecyl group, an isopropyl group, an isobutyl group, an isoamyl group, a chloromethyl group, a chloroethyl group and a hydroxethyl group. Preferred examples of groups for $R^1$ are a methyl group, an ethyl group and a phenyl group.

Representative examples of alkoxyl groups containing 1 to 5 carbon atoms include a methoxy group, an ethoxy group, and a propoxy group.

Representative examples of phenyl group include a phenyl group and a m-tolyl group.

Exemplary halogen atoms for X include a fluorine atom, a chlorine atom, a bromine atom and an iodine atom. Preferred examples of X are a hydrogen atom, a chlorine atom, a bromine atom, a cyano group and a nitro group.

n is preferably 1 or 2.

Examples of groups for Ar include an o-phenylene group, a m-phenylene group, a p-phenylene group, a 1,2,4-benzenetriyl group, a 1,2-naphthalene group, a 2,4-pyridinediyl group, a 2,5-furandiyl group and a 2,5-thiophenediyl group. Of these groups, a p-phenylene group, a 2,4-pyridinediyl group, a 2,5-furandiyl group and a 2,5-thiophenediyl group are preferred.

Preferred examples of the atomic group represented by Xn—Ar—CH= include a benzylidene group, a 4-chlorobenzylidene group, a 4-bromobenzilidene group, a 4-cyanobenzylidene group, a 4-nitrobenzylidene group, a 4-pyridylmethylidene group, a furfurylidene group, a 5-nitrofurfurylidene group and a 2-thenylidene group.

Representative examples of those compounds represented by the Formula (I) which can be used in this invention are 5-benzylidene-1,3-diethylthiobarbituric acid, 5-(4'-chlorobenzylidene)-1,3-diethylthiobarbituric acid, 5-(4'-bromobenzylidene)-1,3-diethylthiobarbituric acid, 5-(4'-cyanobenzylidene)-1,3-diethylbarbituric acid, 5-(4'-nitrobenzylidene)-1,3-diethylthiobarbituric acid, 5-(2'-nitrobenzylidene)-1,3-diethylthiobarbituric acid, 5-(3'-nitrobenzylidene)-1,3-diethylthiobarbituric acid, 5-(3'-chlorobenzylidene)-1,3-diethylthiobarbituric acid, 5-(3'-bromobenzylidene)-1,3-diethylthiobarbituric acid, 5-(2',4'-dinitrobenzylidene)-1,3-diethylthiobarbituric acid, 5-(2',4'-dicyanobenzylidene)-1,3-diethylthiobarbituric acid, 5-(4'-pyridinylidene)-1,3-diethylthiobarbituric acid, 5-(3'-pyridylmethylidene)-1,3-diethylthiobarbituric acid, 5-(2'-pyridylmethylidene)-1,3-diethylthiobarbituric acid, 5-furfurylidene-1,3-diethylthiobarbituric acid, 5-(5'-nitrofurfurylidene)-1,3-diethylthiobarbituric acid, 5-thenylidene-1,3-diethylthiobarbituric acid, 5-(5'-nitro-2-thenylidene)-1,3-diethylthiobarbituric acid, 5-(4'-chlorobenzylidene)-1,3-dimethylthiobarbituric acid, 5-(4'-bromobenzylidene)-1,3-dimethylthiobarbituric acid, 5-(4'-cyanobenzylidene)-1,3-dimethylthiobarbituric acid, 5-(4'-nitrobenzylidene)-1,3-dimethylthiobarbituric acid, 5-(4'-pyridylmethylene)-1,3-dimethylthiobarbituric acid, 5-(5'-nitrofurfurylidene)-1,3-dimethylthiobarbituric acid, 5-(4'-cyanobenzylidene)-1,3-di(n-propyl)-thiobarbituric acid, 5-(4'-nitrobenzylidene)-1,3-di(n-propyl)thiobarbituric acid, 5-(4'-cyanobenzylidene)-1,3-diisopropylthiobarbituric acid, 5-(4'-nitrobenzylidene)-1,3-diisopropylthiobarbituric acid, 5-(4'-chlorobenzylidene)-1,3-diphenylthiobarbituric acid, 5-(4'-bromobenzylidene)-1,3-diphenylthiobarbituric acid, 5-(4'-cyanobenzylidene)-1,3-diphenylthiobarbituric acid, 5-(4'-nitrobenzylidene)-1,3-diphenylthiobarbituric acid, 5-(4'-pyridylmethylene)-1,3-diphenylthiobarbituric acid, 5-(5'-nitrofurfurylidene)-1,3-diphenylthiobarbituric acid, etc.

These compounds can be synthesized by dehydration-condensation of an aldehyde and 1,3-dialkylthiobarbituric acid or 1,3-diphenylthiobarbituric acid in the presence of an alkali as a catalyst (e.g., amines, such as diethylamine, triethylamine, piperidine, ammonia, NaOH, KOH, $CH_3COONH_4$) according to the Knoevenagel condensation process as described in *Organic Reactions,* Vol. 15, pages 204 to 599 (1949).

Photoconductive polymers which can be used in this invention are those polymers containing a $\pi$ electron system in the main chain or in a side chain thereof.

Thiobarbituric acid derivatives represented by the Formula (I) combine with the $\pi$ electron system present in the photoconductive polymers to form a charge transfer complex. Typical examples of such $\pi$ electron systems include aromatic hydrocarbons such as naphthalene, anthracene, pyrene, perylene, acenaphthene, phenylanthracene, diphenylanthracene, etc.; heterocyclic compounds such as carbazole, indole, acridine, 2-phenylindole, N-phenylcarbazole, etc.; and their halogen atom, lower alkyl group containing 1 to 6 carbon atoms or alkoxyl group containing 1 to 5 carbon atoms-substituted derivatives.

In this invention, those polymers containing these $\pi$ electron systems are used as photoconductive polymers. Examples of such polymers which can be used in this invention include vinyl polymers such as polyvinyl naphthalene, polyvinyl anthracene, polyvinyl pyrene, polyvinyl perylene, polyacenaphthylene, polystyryl anthrathene, polyvinyl carbazole, polyvinyl indole, polyvinyl acridine, etc.; vinyl ether polymers such as polyanthrylmethylvinyl ether, polypyrenylmethylvinyl ether, polycarbazolylethylvinyl ether, polyindolylethylvinyl ether, etc.; epoxy resins such as polyglycidyl carbazole, polyglycidyl indole, poly-p-glycidyl anthrylbenzene, etc.; homo- or co-polymers containing the $\pi$ electron system as a substituent, such as polybenzylacrylate, polybenzylmethacrylate, etc.; and condensation polymers of the above $\pi$ electron system compounds and formaldehyde. Of these polymers, poly-N-vinyl carbazole and N-vinyl carbazole copolymers are preferred.

Suitable N-vinyl carbazole copolymers are copolymers containing 50% by mole or more of the N-ethylene carbazole constitutional repeating unit of the formula

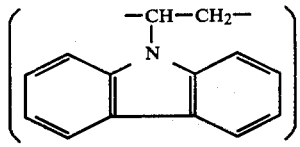

The constitutional repeating units making up the remainder of the N-vinyl carbazole copolymers which can be used include 1-phenylethylene, 1-cyanoethylene, 1-cyano-1-methylethylene, 1-chloroethylene, 1-(alkoxycarbonyl)-ethylenes, 1-(alkoxycarbonyl)-1-methylethylenes. These units are derived from styrene, acrylonitrile, methacrylonitrile, vinyl chloride, alkyl acrylates and alkyl methacrylates, respectively. As the alkyl group of the alkoxycarbonyl group, those alkyl groups containing 1 to 18 carbon atoms can be used, and suitable examples include a methyl group, an ethyl group, a hexyl group, a lauryl group, a stearyl group, and 4-methylcyclohexyl group. The term "constitutional repeating unit" as used herein is the same as defined in *Kobunshi,* Vol. 27, pages 345 to 359 (1978) (Japanese version of *Pure and Applied Chemistry,* Vol. 48, pages 373–385 (1976)).

With regard to the ratio of the thiobarbituric acid derivative of the Formula (I) to the photoconductive polymer which is used, the thiobarbituric acid derivative of the Formula (I) is employed in a ratio of 0.02 to 1.5 moles, preferably 0.05 to 1.2 moles, per mole of the constitutional repeating unit containing the $\pi$ electron system, present in the photoconductive polymer. Where the photoconductive polymer is poly-N-vinyl carbazole or an N-vinyl carbazole copolymer, the constitutional repeating unit containing the $\pi$ electron system is an N-ethylene carbazole unit.

Other known sensitizers, binders, plasticizers, dyes, pigments, etc. as necessary can be incorporated as well as the above described two components, in the photoconductive composition of this invention within ranges which do not deteriorate characteristics of the photoconductive composition of this invention.

The photoconductive composition of this invention can be prepared by dissolving the above described two essential components and other components employed as necessary in a suitable solvent in appropriate ratios to thereby provide a uniform solution (photoconductive composition solution) and then removing the solvent (for example, by evaporation). Depending upon the purpose, the photoconductive composition solution can be used as it is without removing the solvent.

The electrophotographic light-sensitive medium of this invention is prepared by coating the photoconductive composition solution as obtained above on a support with a surface of suitable electrical conductivity and then by drying the coating to form a photoconductive layer.

Depending upon the application where it is used, an adhesion layer, an overcoat layer, etc. may also be employed.

Solvents which are usually used in preparing the photoconductive composition solution are those solvents capable of dissolving both the photoconductive polymer and the barbituric acid derivative of the Formula (I), such as tetrahydrofuran, dioxane, 1,2-dichloroethane, dichloromethane, monochlorobenzene, cyclohexanone, etc.

Drums or sheets of metals, e.g., aluminum, copper, iron, zinc, etc., and paper, plastics, glass, etc., the surface of which is rendered electrically conductive by metal vapor-deposition, lamination of a metal foil, or by a method in which carbon black, a metal powder or the like is dispersed in a binder polymer and coated thereon, can be used as supports with an electrically conductive surface.

The photoconductive composition of this invention can be pulverized, dispersed in an electrically insulating solvent, and used in the electrophoresis photographic process as described in U.S. Pat. Nos. 3,384,565, 3,384,488 and 3,510,419 (corresponding to Japanese Patent Publication Nos. 21781/1968, 37125/1972 and 36079/1971, respectively) to form an image.

The thiobarbituric acid derivative of the Formula (I) combines with the constitutional repeating unit containing the $\pi$ electron system present in the photoconductive polymer to form a charge transfer complex in the photoconductive composition of this invention, and the photoconductive composition therefore is photosensitive in the range of ultraviolet light to visible light (from a wavelength of about 300 nm to a wavelength of about 760 nm).

The following examples are given to illustrate this invention in greater detail. Unless otherwise indicated all parts, percents, ratios and the like are by weight.

EXAMPLES 1 TO 20

A mixture of 1 g of polyvinyl carbazole (PVCz) and a thiobarbituric acid derivative (ThBAD) in an amount of 0.1 to 1.2 moles per mole of the N-ethylenecarbazole constitutional repeating unit was dissolved in 30 g of dichloroethane and coated on an electrically conductive film (a member prepared by providing a 60 nm thick $In_2O_3$ layer on a 100 $\mu$m thick polyethylene terephthalate film) to form a coating film of a dry thickness of 1.5 $\mu$m. This coated film was dried for 30 minutes at 80° C. and allowed to stand in a dark place overnight. The coated film so processed was charged to plus 200 V using a corona discharge. In each example, the quantity of charge held at 80% even 1 minute after the charging. In order to examine the sensitivity, the quantity of light required to reduce the surface potential from 180 V to 90 V (half-reduction exposure amount) was measured. A 6000 lux tungsten lamp was used through an ND Filter of O.D. (optical density) 3.

TABLE 1

| Example | Thiobarbituric Acid Derivative | ThBAD/PVCz Molar Ratio* | Half-Reduction Exposure Amount (Lux · sec) |
|---|---|---|---|
| 1 | 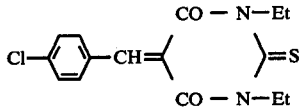 | 0.1 | 120 |
| 2 | 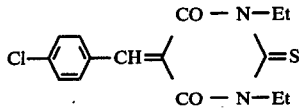 | 0.5 | 80 |
| 3 | 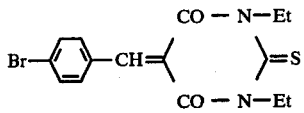 | 0.1 | 110 |
| 4 | 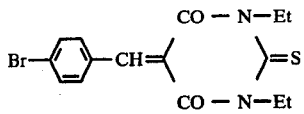 | 0.5 | 76 |

TABLE 1-continued
| Example | Thiobarbituric Acid Derivative | ThBAD/PVCz Molar Ratio* | Half-Reduction Exposure Amount (Lux · sec) |
|---|---|---|---|
| 5 | 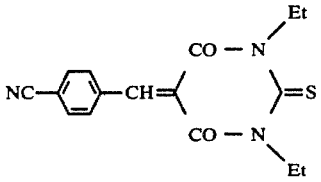 | 0.1 | 51 |
| 6 | 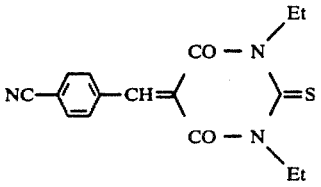 | 0.5 | 16 |
| 7 | 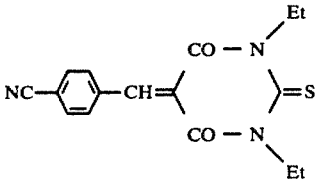 | 1 | 10 |
| 8 | 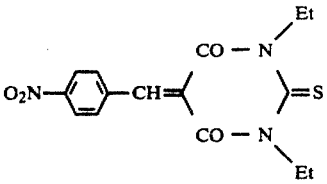 | 0.1 | 51 |
| 9 | 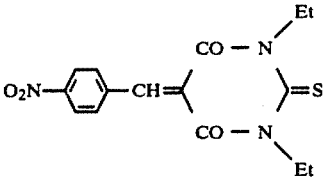 | 0.5 | 14 |
| 10 | 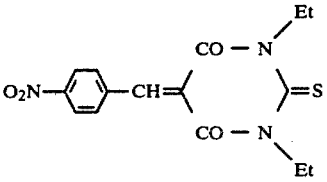 | 1 | 10 |
| 11 | 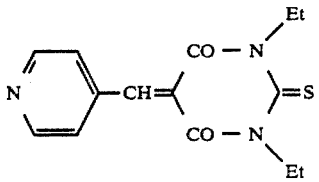 | 0.1 | 110 |
| 12 | 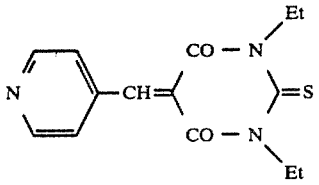 | 0.5 | 76 |

TABLE 1-continued

| Example | Thiobarbituric Acid Derivative | ThBAD/PVCz Molar Ratio* | Half-Reduction Exposure Amount (Lux · sec) |
|---|---|---|---|
| 13 | 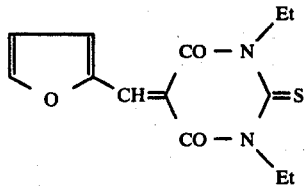 | 0.1 | 110 |
| 14 | 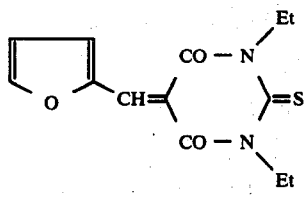 | 0.5 | 74 |
| 15 | 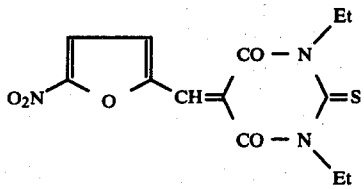 | 0.1 | 50 |
| 16 | 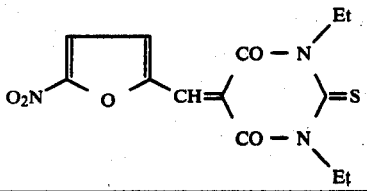 | 1 | 10 |

*Moles of thiobarbituric acid derivative per mole of N—ethylenecarbazole constitutional repeating unit of PVCz.

EXAMPLE 21

A mixture of 0.2 g of polyvinyl carbazole and 0.1 g of 5-(4'-nitrobenzylidene)-1,3-diethylthiobarbituric acid was dissolved in a mixed solvent of 100 g of methylene chloride and 50 g of an electrically insulating solvent, Isopar H (trade name for an isoparaffin-based petroleum solvent produced by Esso Petroleum Co.). Then, on evaporating the methylene chloride at 50° to 70° C., particles in which polyvinyl carbazole and 5-(4'-nitrobenzylidene)-1,3-diethylthiobarbituric acid were mutually dissolved in each other were obtained in a condition that they were dispersed in the Isopar H. By using the solution with particles dispersed therein as prepared above, the electrophoresis photographic process as described in Japanese Patent Publication No. 21781/1978 was followed wherein a minus voltage of 1500 V was applied and light-exposure was effected for 1 second by use of a 2 lux (illumination at the surface of the solution wherein photoconductive particles were dispersed) tungsten lamp. Thus, an image was obtained.

EXAMPLE 22

The procedure of Example 21 was repeated wherein 5-(5'-nitrofurfurylidene)-1,3-diethylthiobarbituric acid was used in place of 5-(4'-nitrobenzylidene)-1,3-diethylthiobarbituric acid. Also in this example, an equivalent image was obtained.

While the invention has been described in detail and with reference to specific embodiments thereof, it will be apparent to one skilled in the art that various changes and modifications can be made therein without departing from the spirit and scope thereof.

What is claimed is:

1. A photoconductive composition comprising a mixture of a photoconductive substance and a thiobarbituric acid derivative in a sensitizing amount represented by the formula (I):

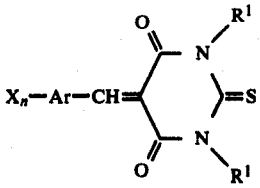

(I)

wherein $R^1$ is an alkyl group containing 1 to 12 carbon atoms, an alkoxyl group containing 1 to 5 carbon atoms, or a phenyl group; X is a hydrogen atom, a halogen atom, a cyano group or a nitro group; Ar is a divalent, trivalent or tetravalent group derived from benzene, naphthalene, pyridine, furan or thiophene; and n is 1, 2 or 3, wherein the photoconductive substance is a polymer with a pi electron system in a main or side chain thereof.

2. The photoconductive composition as claimed in claim 1, wherein the thiobarbituric acid derivative is present in said mixture in an amount of 0.02 to 1.5 moles per mole of the constitutional repeating unit containing the $\pi$ electron system present in the photoconductive polymer.

3. The photoconductive composition as claimed in claims 1 or 2, wherein said alkyl group for $R^1$ is a methyl group, an ethyl group, a propyl group, a butyl group, a pentyl group, a hexyl group, an octyl group, a nonyl group, a decyl group, a dodecyl group, an isopropyl group, an isobutyl group, an isoamyl group, a chloromethyl group, a chloroethyl group or a hydroxyethyl group, said alkoxyl group for $R^1$ is a methoxy group, an ethoxy group or a propoxy group, said halogen atom for X is a fluorine atom, a chlorine atom, a bromine atom or an iodine atom and said Ar is an m-phenylene group, a p-phenylene group, a 1,2,4-benzenetriyl group, a 1,2-naphthalene group, a 2,4-pyridinediyl group, a 2,5-furandiyl group or a 2,5-thiophenediyl group.

4. The photoconductive composition as claimed in claims 1 or 2, wherein $R^1$ is a methyl group, an ethyl group or a phenyl group, X is a hydrogen atom, a chlorine atom, a bromine atom, a cyano group or a nitro group, n is 1 or 2, and Ar is a p-phenylene group, a 2,4-pyridinediyl group, a 2,5-furandiyl group or a 2,5-thiophenediyl group.

5. The photoconductive composition as claimed in claims 1 or 2, wherein said thiobarbituric derivative represented by the formula (I) is 5-(4'-cyanobenzylidene)-1,3-diethylthiobarbituric acid, 5-(4'-nitrobenzylidene)-1,3-diethylthiobarbituric acid or 5-(5'-nitrofurfurylidene)-1,3-diethylthiobarbituric acid.

6. An electrophotographic light-sensitive medium comprising a support with an electrically conductive surface thereon and a layer of the photoconductive composition as claimed in claims 1 or 2.

7. The electrophotographic light-sensitive medium as claimed in claim 6 wherein said alkyl group for $R^1$ is a methyl group, an ethyl group, a propyl group, a butyl group, a pentyl group, a hexyl group, an octyl group, a nonyl group, a decyl group, a dodecyl group, an isopropyl group, an isobutyl group, an isoamyl group, a chloromethyl group, a chloroethyl group or a hydroxyethyl group, said alkoxyl group for $R^1$ is a methoxy group, an ethoxy group or a propoxy group, said halogen atom for X is a fluorine atom, a chlorine atom, a bromine atom or an iodine atom and said Ar is a m-phenylene group, a p-phenylene group, a 1,2,4-benzenetriyl group, a 1,2-naphthalene group, a 2,4-pyridinediyl group, a 2,5-furandiyl group or a 2,5-thiophenediyl group.

8. The electrophotographic light-sensitive medium as claimed in claim 6, wherein $R^1$ is a methyl group, an ethyl group or a phenyl group, X is a hydrogen atom, a chlorine atom, a bromine atom, a cyano group or a nitro group, n is 1 or 2, and Ar is a p-phenylene group, a 2,4-pyridinediyl group, a 2,5-furandiyl group or a 2,5-thiophenediyl group.

9. The electrophotographic light-sensitive medium as claimed in claim 6, wherein said thiobarbituric derivative represented by the formula (I) is 5-(4'-cyanobenzylidene)-1,3-diethylthiobarbituric acid, 5-(4'-nitrobenzylidene)-1,3-diethylthiobarbituric acid or 5-(5'-nitrofurfurylidene)-1,3-diethylthiobarbituric acid.

10. The electrophotographic light-sensitive medium as claimed in claim 6, wherein the $\pi$ electron system is present in a moiety derived from an aromatic hydrocarbon selected from the group consisting of naphthalene, anthracene, pyrene, perylene, acenaphthene, phenylanthracene, and diphenylanthracene or derived from a heterocyclic selected from the group consisting of carbazole, indole, acridine, 2-phenyl indole, N-phenylcarbazole, their halogen atom derivatives, and their lower alkyl group derivatives.

11. The electrophotographic light-sensitive medium as claimed in claim 6, wherein said photoconductive substance is a poly-N-vinyl carbazole or an N-vinyl carbazole copolymer.

12. The photoconductive composition as claimed in claims 1 or 2, wherein X is the cyano group.

13. The photoconductive composition as claimed in claims 1 or 2, wherein X is the nitro group.

* * * * *